US007217105B2

(12) United States Patent
Angove

(10) Patent No.: US 7,217,105 B2
(45) Date of Patent: May 15, 2007

(54) INTEGRATED PUMP AND WASH PUMP

(75) Inventor: Garret Angove, Osterville, MA (US)

(73) Assignee: Sapphire Engineering, Inc., Pocasset, MA (US)

( * ) Notice: Subject to any disclaimer, the term of this patent is extended or adjusted under 35 U.S.C. 154(b) by 484 days.

(21) Appl. No.: 10/887,628

(22) Filed: Jul. 12, 2004

(65) Prior Publication Data

US 2006/0008372 A1 Jan. 12, 2006

(51) Int. Cl.
*F04B 7/00* (2006.01)
*F04B 23/10* (2006.01)
*F04B 39/08* (2006.01)

(52) U.S. Cl. ..... 417/199.1; 92/165 R; 417/505; 417/519; 417/539; 417/559

(58) Field of Classification Search ..... 92/162 R, 92/165 R, 166, 170.1; 137/625.21, 625.31; 417/199.1, 505, 519, 539, 559
See application file for complete search history.

(56) References Cited

U.S. PATENT DOCUMENTS 1,546,596 A * 7/1925 Mader ..... 417/568
3,030,118 A * 4/1962 Groce ..... 277/563
3,053,195 A * 9/1962 Williamson ..... 92/165 R
7,080,975 B2 * 7/2006 Besse et al. ..... 417/505

* cited by examiner

*Primary Examiner*—Michael Koczo, Jr.
(74) *Attorney, Agent, or Firm*—Paul J. Cook

(57) ABSTRACT

A pump apparatus is provided which comprises a first displacement pump and a ceramic valve construction formed of a ceramic rotor, a ceramic stator having flat surfaces which are positioned in sealing relationship and a second displacement pump having check valves. The first displacement pump comprises a reciprocating first piston within a housing having an interior wall spaced apart from the piston. The position of the first piston and the position of the rotor are controlled to effect desired fluid flow through the stator. The first piston and a second piston of the second displacement pump are reciprocated by a common motor.

17 Claims, 7 Drawing Sheets

INTEGRATED PUMP AND WASH PUMP

BACKGROUND OF THE INVENTION

This invention relates to an integrated pump and ceramic valve apparatus for pumping discrete liquid volumes to points of use of the liquid volumes. More particularly, this invention relates to an integrated displacement pump and ceramic valve for pumping discrete liquid volumes to points of use.

At the present time, discrete liquid volumes are pumped with a syringe pump comprising a barrel, a face seal which moves within the barrel and a reciprocating plunger attached to the face seal. The syringe pump includes a valve construction formed of a polymeric composition which directs the pumped liquid volumes to a point of use. The valve construction includes a housing having a hollow, essentially conical interior surface into which is press fit a mating, essentially conical rotor. The rotor is provided with fluid passageways that control flow of liquid into the syringe pump and flow of liquid from the syringe pump while providing sealing between a pump inlet and a pump outlet. Since organic solvents and diluents are sometimes used to form the liquid being pumped such as dimethylsulfoxide (DMSO) or tetrahydrofuran (THF), the valve rotor commonly swells which causes it to deteriorate. Also, the use of the conically shaped seal limits the pressure at which the liquid is pumped while retaining desired sealing since higher pressures increase the difficulty in rotating the valve rotor. Operating pressures are also limited due to the use of polymeric materials in the valve such as polytetrafluoroethylene (PTFE) which tend to cold flow at elevated pressures.

While the available syringe pumps have been useful for their intended purpose, they also have disadvantages. In order to attain a tight fit between the barrel and the face seal, the manufacturing of both the barrel and face seal must be made at tight tolerances. In addition, when utilizing the most commonly used materials comprising a glass barrel and a (PTFE) face seal, undesirable shedding of the PTFE occurs which contaminates the liquid being pumped. Furthermore, a tight fit between the barrel and face seal results in chattering of the face seal during its movement within the barrel. This leads to a loss of control of the liquid volume being pumped. In addition, the average useful life of presently available syringe pumps is only about 10 to about 100,000 cycles.

An additional problem encountered in presently available pumps is residue buildup at the pump seals which reduce useful pump life. While it may be possible to supply wash water to the pump seal to reduce residual build up, such an arrangement would require a separate motor to activate a pump for the wash water.

Accordingly, it would be desirable to provide a pump apparatus capable of delivering discrete liquid volumes to a point of use such as different areas of a sample tray in a maimer which is repeatable for long time periods of 1,000,000 cycles or more. In addition, it would be desirable to provide such a pump apparatus which avoids shedding of polymeric particles during pumping. Furthermore, it would be desirable to provide such a pump wherein internal seals can be cleaned periodically or continuously without the need for a motor in addition to the motor for the pump apparatus.

SUMMARY OF THE INVENTION

The present invention provides a pumping apparatus comprising (a) a displacement pump having a liquid displacement element comprises a piston housed within a barrel, a high pressure seal and means for reciprocating the piston within the barrel and (b) a ceramic valve wherein the sealing surfaces of a ceramic rotor and mating ceramic stator are flat and (c) a pump for a wash liquid for a seal of the displacement pump. Control apparatus, including a conventional microprocessor is provided to synchronize movement of the valve rotor and the piston position of the displacement pump so that liquid in the barrel is delivered to a point of use while the piston is traveling toward the ceramic valve and liquid is supplied to the barrel when the piston is traveling away from the ceramic valve. The moving piston is spaced apart from the inside surface of the barrel so that a frictional force between the piston and the barrel is prevented during pumping. By providing flat ceramic sealing surfaces, in the ceramic valve, useful pressure at which the liquid is pumped can exceed useful pumping pressures with presently available syringe pumps. The pump for the wash liquid also is a displacement pump comprising a piston housed within a barrel but utilizing two check valves rather than a ceramic rotor and stator valve to control wash liquid flow from a reservoir to a seal for the displacement pump for the liquid barrel in element (a).

DESCRIPTION OF SPECIFIC EMBODIMENTS

Figure 1:
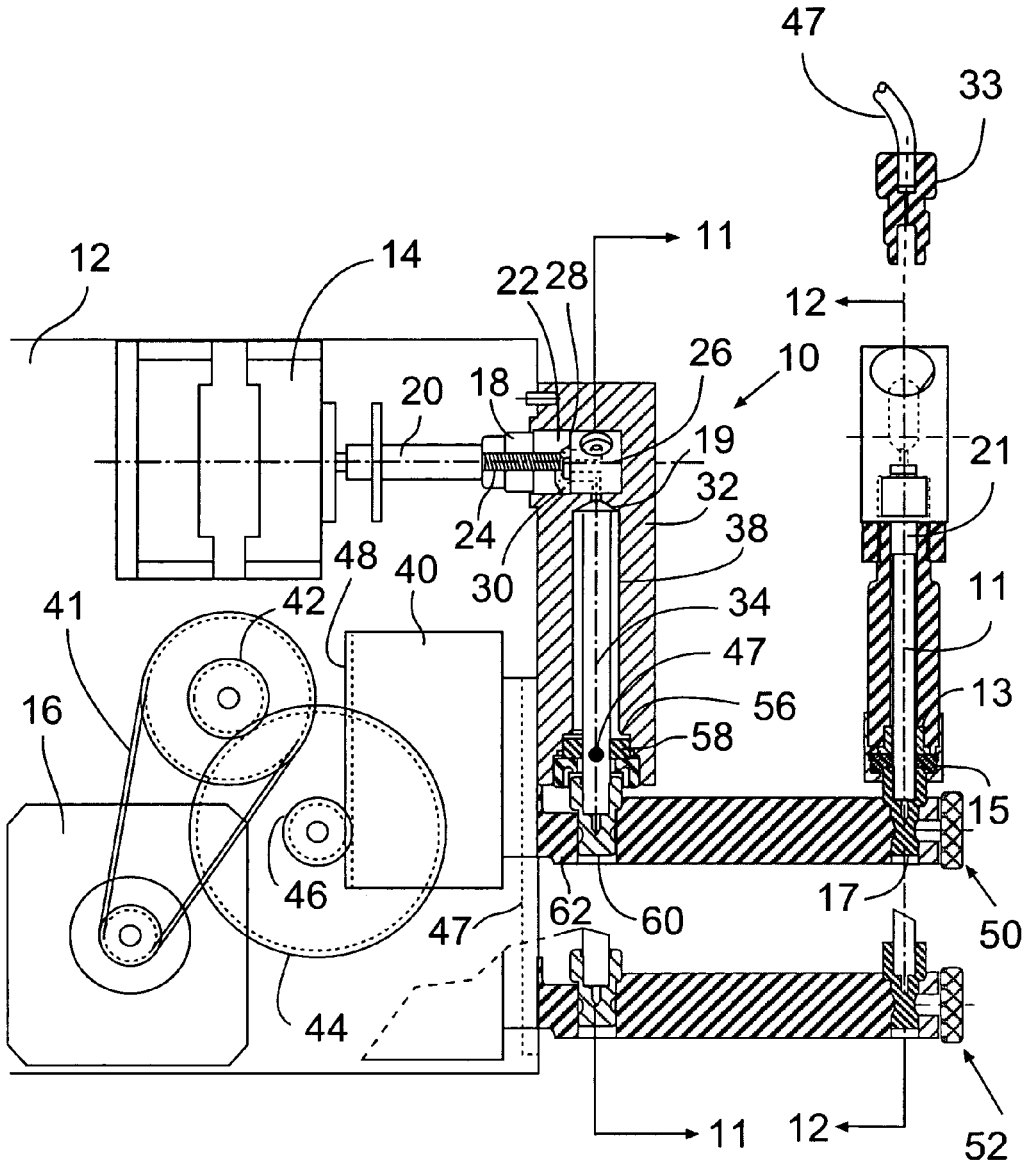
FIG. 1 is a side view of the displacement pump and ceramic valve of this invention.
Figure 2:
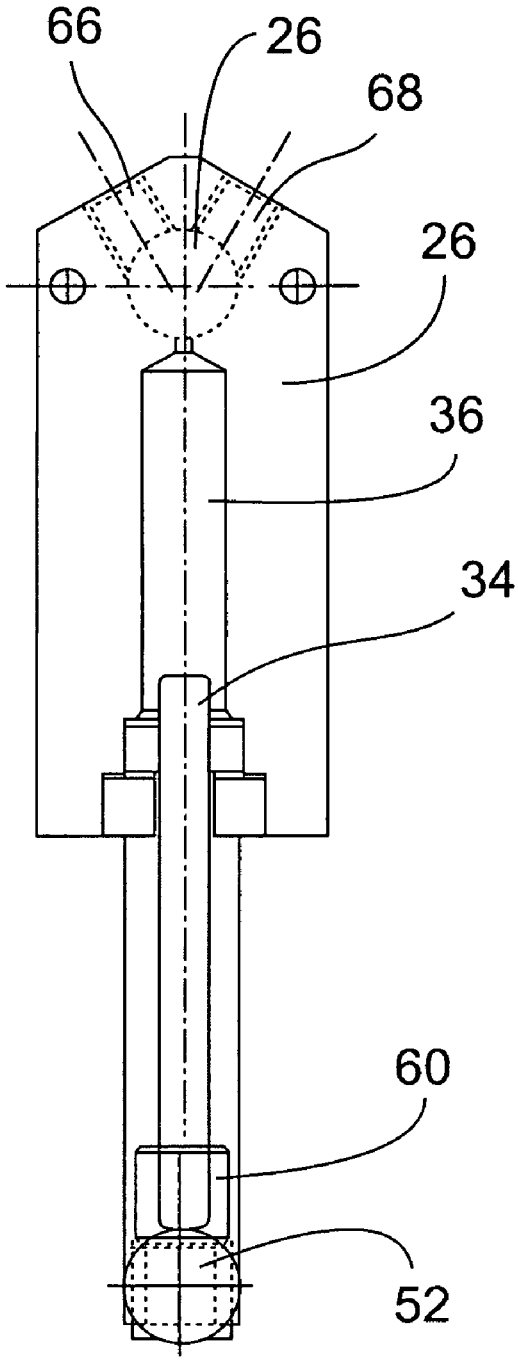
FIG. 2 is a front view of the apparatus of FIG. 1.

Referring to FIGS. 1 and 2, the pump apparatus 10 of this invention includes a housing 12 for a motor 14 which effects linear motion such as a stepper motor, a lead screw, a rotary solenoid or the like and a motor 16 which effects rotation. Motor 14 is connected to rotor/stator coupling 18 through arm 20 which can be rigid or a self aligning spring drive. The rotor/stator coupling 18 is biased into ceramic rotor 22 by spring 24. Rotor 22 is sealed against ceramic stator 26 at stator flat polished surface 28 and rotor flat polished surface 30. The ceramic rotor 20 and ceramic stator 26 can be formed of aluminum, zirconia, silica, tantalum oxide, or the like. Mating surfaces 28 and 30 are rendered flat such as by a conventional lapping process. Since mating surfaces 28 and 30 are flat, a significantly lower torque force at a given pressure is required to effect rotation of the rotor as compared to a conically shaped rotor and stator.

The stator 26 is positioned within housing 32 which can be formed of an opaque or transparent material which is resistant to the liquid being pumped such as acrylic, polyetherether ketone, or the like. Housing 32 can be a single piece or a plurality of joined elements. The piston 34 can be formed of sapphire, glass or a ceramic or the like and is spaced apart from the interior wall 38 of housing 32. When the piston 34 is so-positioned, a single stroke of the piston 34 during use of the pump will deliver a known volume of liquid depending upon the piston diameter and the stroke length. As shown in FIG. 1, the housing 32 for the stator 26 and the piston 34 can be formed of a single element. The provision of this single element housing provides the advantage that the valve and displacement pump of this invention can be replaced simultaneously after the useful life of the pump and valve is completed.

Motor 16 causes gear box 40 to reciprocate through pulley 41, and gears 42, 44 and 46 and gear track 48. Gear box 40 is positioned within track 47 which causes the piston 34 to move in a repeatable linear path stroke after stroke. As shown in FIG. 1, the stroke of the pump varies from position 50 and position 52 which typically can be between about 1.5 and 2.0 inches. It is to be understood that any convention activating apparatus which causes piston 34 to reciprocate on a linear path can be utilized in the present invention.

The piston 34 is positioned within seal 56 which can be formed, for example of ultra high molecular weight polyethylene or the like and optional rulon guide 58. The rulon guide aligns piston 34 into seal 56. The piston 34 reciprocates within seal 56 and rulon guide 54. The piston 34 is fixedly positioned in ferrule 60 which, in turn, is fixed within arm 62 by knob 50.

Figure 3:
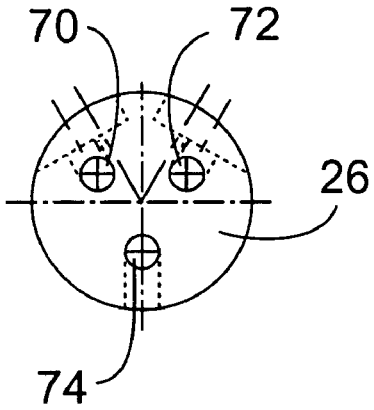
FIG. 3 is a front view of a stator of the ceramic valve of this invention.
Figure 4:
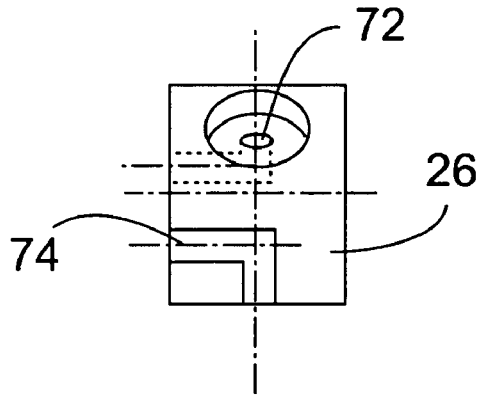
FIG. 4 is a side view of the stator of FIG. 3.

As shown in FIGS. 2, 3 and 4, the stator 26 is in fluid communication with a fluid inlet 66 in head 26 and with fluid outlet 68 in head 26. Fluid is introduced into housing 36 through fluid inlet 66 when piston 34 moves away from stator 26. Fluid is passed through fluid outlet 68 when piston 34 moves toward stator 26. The stator 26 includes fluid passageways 70, 72 and 74. When rotor 22 (FIG. 5) is rotated so that the fluid passageway 80 is in position 82, fluid passes from fluid passageway 70 to fluid passageway 74 and then into housing 36. When rotor 22 (FIG. 5) is rotated so that fluid passageway is in position 84, fluid passes from housing 36, through fluid passageway 74 and through passageway 72 to a point of use (not shown).

Figure 5:
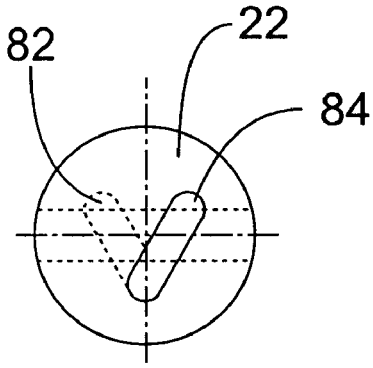
FIG. 5 is a front view of a rotor of the ceramic seal of this invention.
Figure 6:
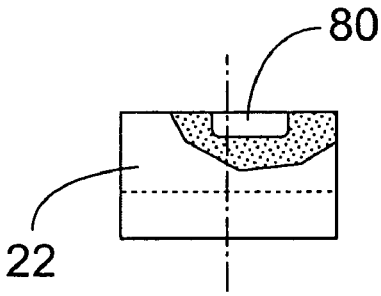
FIG. 6 is a partial cross-sectional view of the rotor of FIG. 5.
Figure 7:
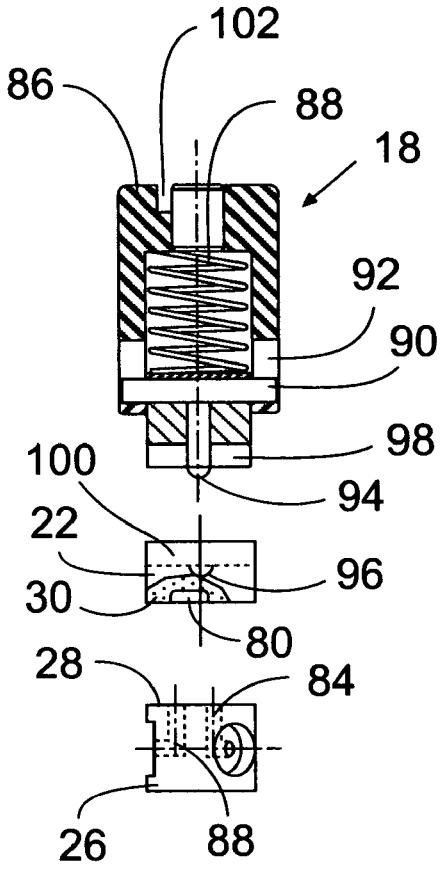
FIG. 7 is an exploded view of the rotor/stator coupling 18 shown in FIG. 1.

Referring to FIG. 7, a rotor/stator coupling 18 which is a self-aligning spring drive is shown. The coupling 18 includes a spring housing 86, a spring 88. The spring 88 bears against pin 90 which is movable within slot 92. Pin 90, in turn, bears against pin 94 which fits into slot 96 of rotor 22. Flange 98 fits into slot 100 of rotor 22. Housing 96 is coupled to arm 20 (FIG. 1) by keyway 102 which fits over a key (not shown) of arm 20 (FIG. 1). When arm 20 is rotated, the rotation is transmitted to rotor 22 through flange 98 and slot 100. It is important to have complete flat contact between surface 28 and 30 so that there is no leakage between position 82 and 84 (FIG. 5). By the term "complete flat contact" as used herein is meant that flat surfaces 28 and 30 do not separate to effect partial contact between them. This complete flat contact is effected even when arm 20 on housing 86 are misaligned since pin 94 rotates within slot 96 and the misalignment is thereby corrected and not transmitted to surface 30 of rotor 22.

Figure 8:
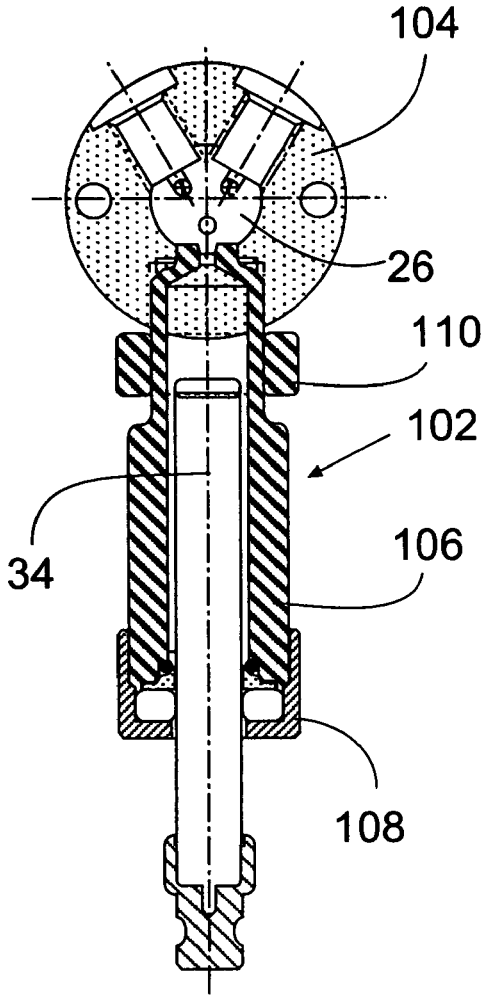
FIG. 8 is a cross-sectional view of the apparatus of this invention made of a multipiece housing.

Referring to FIG. 8, the pump apparatus 102 is shown wherein the housing is formed of a plurality of sections joined by threads. The housing 102 comprises a top section 104 for housing a stator 26, a middle section 106 for housing a piston and a bottom section 108 through which the piston 34 extends. The housing 102 is provided with a threaded collar 110 which can be utilized to effect sealing between top section 104 and middle section 106.

Figure 9:
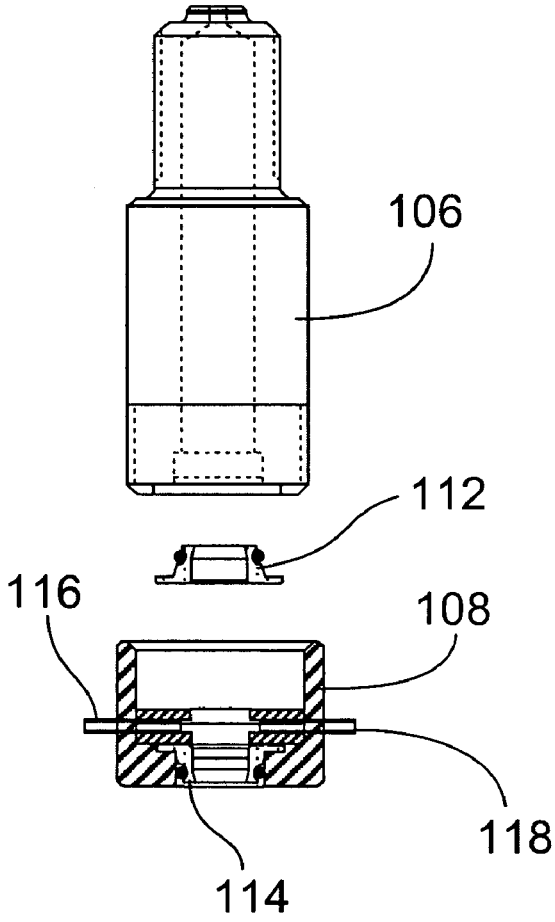
FIG. 9 is an exploded view of this invention including a washing means.

Referring to FIG. 9, an embodiment of this invention is shown having the capability of internal seals. Bottom housing section 108 is attached to middle housing section 106 by threads. Bottom section 108 is provided with seals 112 and 114 through which a piston (not shown) extends. Bottom section 108 is provided with inlet conduit 116 and outlet conduit 118 through which a wash liquid can be passed. The wash liquid is used to wash seals 112 and 114 as well as the interior of housing sections 106 and 108 thereby to prevent build-up at a deposit therein from liquid being pumped therein. Washing can be effected when a top surface of a piston (not shown) extends below conduits 106 and 108.

Figure 10:
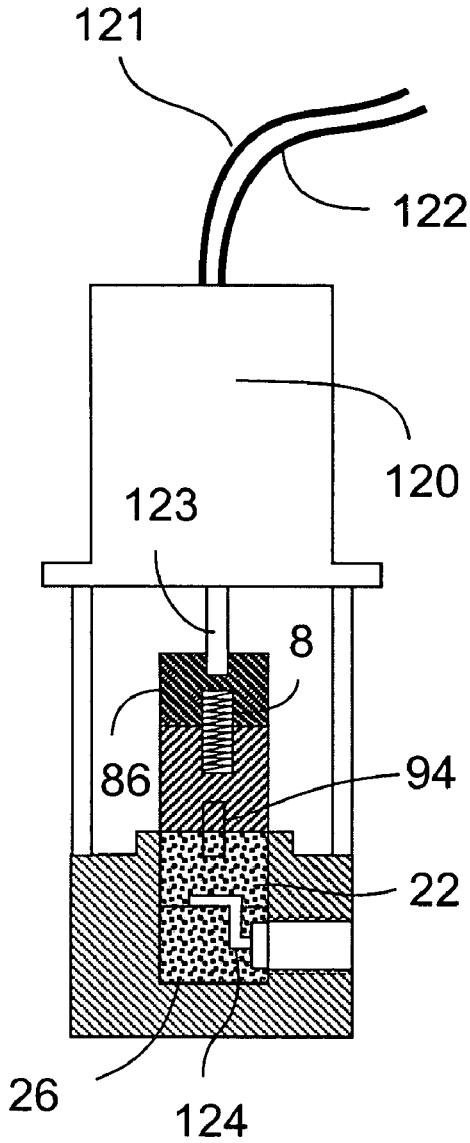
FIG. 10 is a side view of a rotary solenoid that can be used in the present invention.

Referring to FIG. 10, a rotary solenoid 120 is shown having electrical lead wires. Motors 14 and 16 are connected to a common control (not shown) so that the piston is correctly positioned to attain a desired fluid flow through stator 26 and rotor 22 as described above. Electrical leads 121 and 122 are connected to arm 123 positioned in housing 86 into which is positioned pin 94. Pin 94 functions in the manner described above with reference to FIG. 7 to effect rotation of rotor 22 relative to stator 26 to provide a fluid passageway 124.

Figure 11:
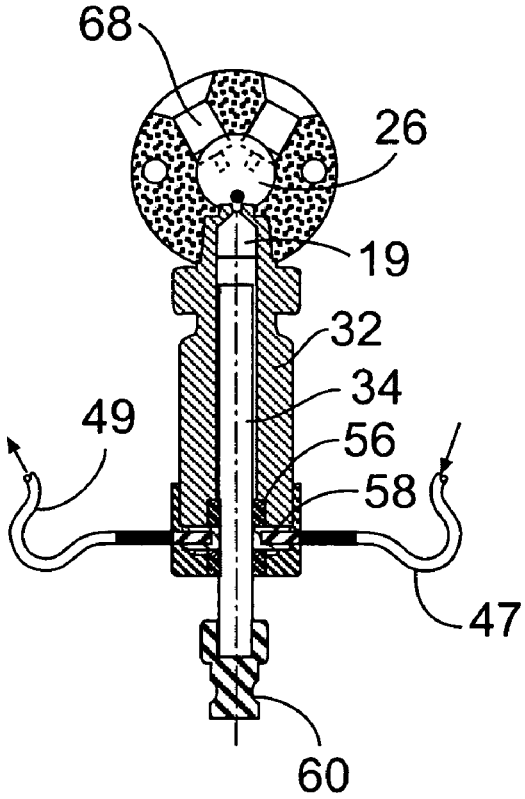
FIG. 11 is a cross-sectional view taken along line 11—11 of FIG. 1.
Figure 12:
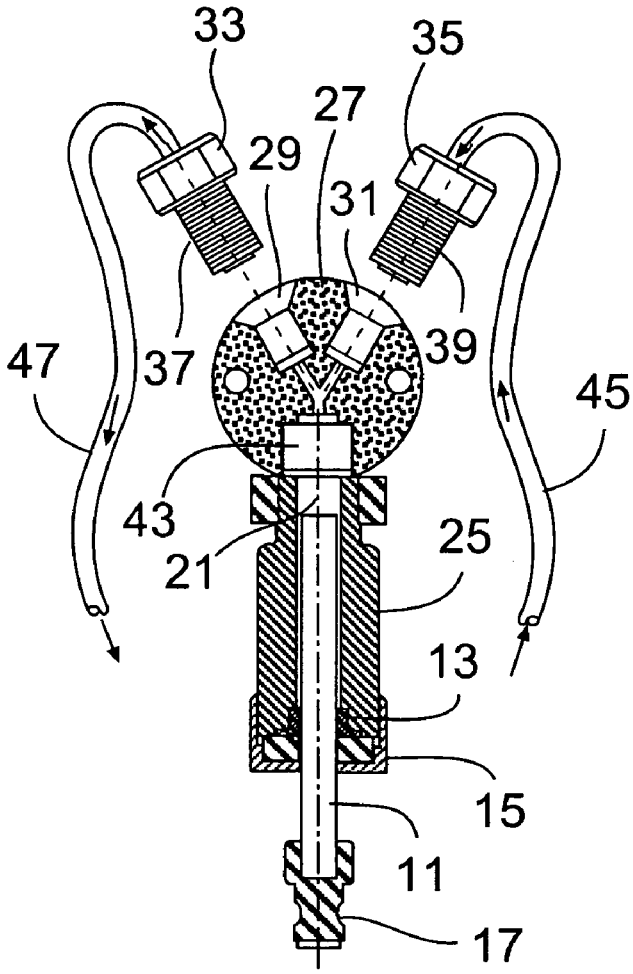
FIG. 12 is a cross-sectional view taken along line 12—12 of FIG. 1.

FIGS. 1, 11 and 12 show wherein two liquids including a wash liquid for the pump seals are simultaneously pumped. Each piston 34 and 11 is positioned within a seal 56 or 13 which can be formed, from (UHMWPE) or the like and optional rulon guide 58 or 15. The rulon guides 58 and 15 align pistons 34 and 11 into seals 56 and 13. The pistons 34 and 11 reciprocate within seals 56 and 11 and rulon guides 54 and 15. The pistons 34 and 11 are fixedly positioned in ferrules 60 and 17 which, in turn, are fixed within arm 62 by knobs 50 and 52. Both pistons 34 and 11 move together when arm 62 is moved by motor 16 (FIG. 1). The volume ratio of the liquids delivered from barrels 19 and 21 with a single stroke of pistons 34 and 11 is controlled by the ratio of the sizes of the pistons 34 and 11.

Referring to FIGS. 11 and 12, the housing can be formed of three pieces comprising piece 32, 25 and 27. Housing piece 27 includes two valve seats 29 and 30 into which are positioned check valves 33 and 35. Check valves 33 and 35 can have threads 37 and 39 to screw the valves 33 and 35 into valve seats 29 and 31 having internal threads (not shown). Housing 27 can be provided with threads 43 to secure housings 27 to housing 25. Check valve 35 is connected to conduit 45 which in turn is connected to a reservoir for wash water (not shown). Check valve 33 is connected to conduit 47 which, in turn, is connected to seal 56 in order to deliver wash water to seal 56. Conduit 49 is connected to seal 56 to remove wash water from seal 56. The wash water substantially prevents build-up of contaminants within seal 56. In use, when piston 11 moves toward check valves 33 and 35, check valve 33 is open and check valve 35 is closed so that wash water is delivered through check valve 33 and conduit 47. When piston 11 moves away from check valve 33, check valve 33 is closed and check valve 35 is open so that fluid moves into barrel 21 through check valve 35 and conduit 45 from a fluid reservoir (not shown).

Figure 13:
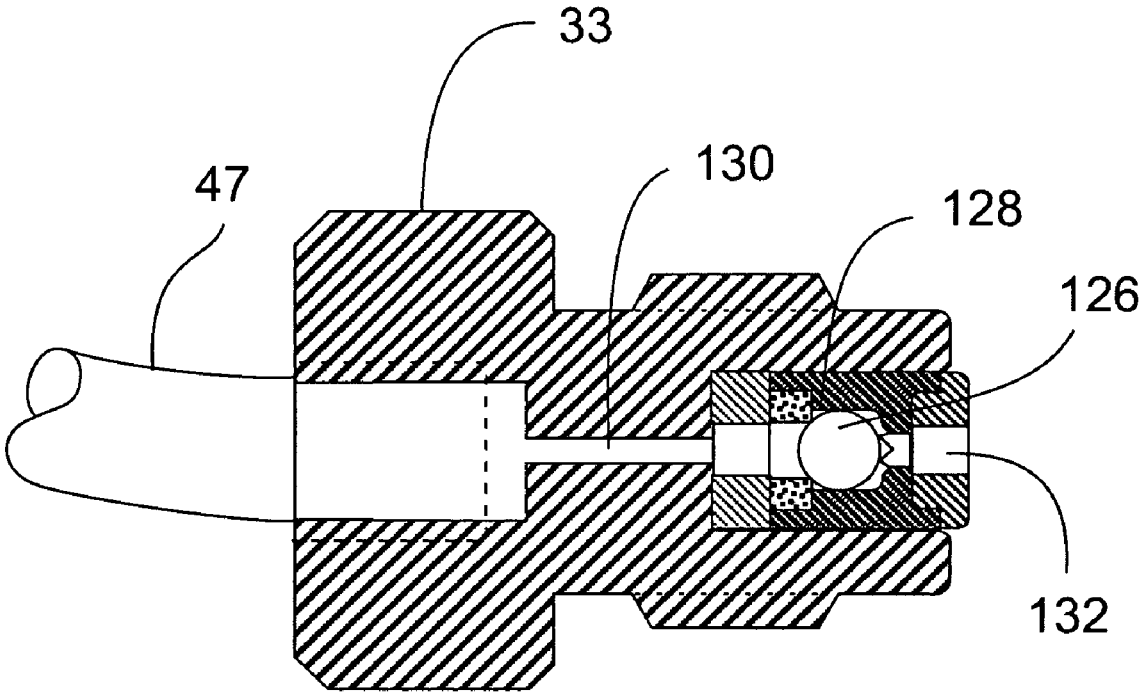
FIG. 13 is a cross-sectional view of a check valve useful in this invention.

Referring to FIG. 13, the valve 33 includes a movable ball 126 which moves within valve seat 128 to block either conduit 130 or conduit 132 to effect fluid flow as described above.

The invention claimed is:

1. A pump apparatus which comprises:

a first displacement pump having a first reciprocatable piston positioned within a first housing having an interior wall spaced apart from said first piston, an interior volume of said first housing being in fluid communication with a fluid inlet to a ceramic stator and a fluid outlet from said ceramic stator, a ceramic rotor and said ceramic stator being positioned in a second housing, said ceramic stator having a first flat surface in sealing relationship with a second flat surface a of a ceramic rotor positioned in contact with said first flat surface of said ceramic stator, said ceramic rotor having a fluid passageway that controls a direction of fluid flow through said ceramic stator, a position of said first piston and a position of said ceramic rotor being synchronized to effect desired fluid flow through said ceramic stator.

a reciprocatable second piston positioned within a third housing a second displacement pump for pumping a fluid having a reciprocatable second piston positioned within a third housing having an interior wall spaced apart from a second piston, an interior volume of said third housing being in fluid communication with a fluid inlet to a first check valve and a fluid outlet from a second check valve, said first check valve being in fluid communication with a point of use for said fluid, said second check valve being in fluid communication with a source of said fluid, said first check valve being open and said second check valve being closed when said piston moves toward said first check valve, said first check valve being closed and said second check valve being open when said piston moves away from said first check valve, each of said first piston and said second piston being movable by a common power source, and wherein a fluid pumped from said second displacement pump is directed to a seal of said first displacement pump, said seal positioned to prevent fluid in said first housing from bypassing said first reciprocatable piston.

2. The pump apparatus of claim 1 wherein said first housing and said second housing are formed of a single element.

3. The pump apparatus of claim 1 wherein said ceramic stator and said ceramic rotor are formed of aluminum oxide.

4. The pump apparatus of claim 2 wherein said ceramic stator and said ceramic rotor are formed of aluminum oxide.

5. The pump apparatus of claim 1 wherein said first housing is formed of a transparent material.

6. The pump apparatus of claim 2 wherein said first housing is formed of a transparent material.

7. The pump apparatus of claim 1 wherein said piston is formed of sapphire.

8. The pump apparatus of claim 2 wherein said piston is formed of sapphire.

9. The pump apparatus of claim 3 wherein said piston is formed of sapphire.

10. The pump apparatus of claim 4 wherein said piston is formed of sapphire.

11. The pump apparatus of claim 5 wherein said piston is formed of sapphire.

12. The pump apparatus of claim 6 wherein said piston is formed of sapphire.

13. The pump apparatus of claim 1 wherein said ceramic rotor is connected to a motor for effecting rotor rotation through a self-aligning coupling which effects complete flat contact between said first flat surface and said second surface when said rotor is rotated and when said rotor is at rest.

14. The pump apparatus of claim 1 including means for periodically washing the interior volume of said first housing.

15. The pump apparatus of claim 13 including means for periodically washing the interior volume of said first housing.

16. The pump apparatus of any one of claims 1, 2, 13, 14 or 15 wherein said rotor is rotated with a rotary solenoid.

17. A pump apparatus which comprises a first displacement pump having a first reciprocatable piston positioned within a first housing having an interior wall spaced apart from said first piston, fluid flow through said first housing being controlled by a stator and rotor in contact with each other and having fluid conduits, a second displacement pump for pumping a fluid having a reciprocatable second piston positioned within a second housing having an interior wall spaced apart from said second piston, fluid flow within said second housing being controlled by check valves, said first piston and said second piston being movable by a common power sources, and wherein a fluid pumped from said second displacement pump is directed to a seal of said first displacement pump, said seal positioned to prevent fluid in said first housing from bypassing said first reciprocatable piston.

* * * * *